US008177200B2

(12) United States Patent
Spicer et al.

(10) Patent No.: US 8,177,200 B2
(45) Date of Patent: May 15, 2012

(54) METHOD AND APPARATUS FOR COOLING PYROLYSIS EFFLUENT

(75) Inventors: David B. Spicer, Houston, TX (US); Robert D. Strack, Houston, TX (US); George Stephens, Huffman, TX (US); James M. Frye, Shinjuku-ku (JP)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

(21) Appl. No.: 13/153,893

(22) Filed: Jun. 6, 2011

(65) Prior Publication Data

US 2011/0233797 A1 Sep. 29, 2011

Related U.S. Application Data

(62) Division of application No. 11/866,175, filed on Oct. 2, 2007, now Pat. No. 8,074,973.

(51) Int. Cl.
*B01F 3/04* (2006.01)

(52) U.S. Cl. ..... 261/153; 261/118; 261/155; 208/48 Q

(58) Field of Classification Search ..... 261/112.1, 261/116, 118, 153, 155; 422/207; 208/48 Q
See application file for complete search history.

(56) References Cited

U.S. PATENT DOCUMENTS 3,219,419 A 11/1965 Braconier et al.
3,224,215 A 12/1965 Bramckamp et al.
3,515,519 A 6/1970 Sennewald et al.
3,583,476 A 6/1971 Woebcke et al.
3,593,968 A 7/1971 Geddes
3,647,907 A 3/1972 Sato et al.
3,904,722 A 9/1975 Onoda et al.
(Continued)

FOREIGN PATENT DOCUMENTS

EP 0 810 414 9/1997
(Continued)

OTHER PUBLICATIONS

H. Hermann & W. Burghardt, Latest Developments in Transfer Line Exchanger Design for Ethylene Plants, Schmidt'sche Heissdampf-Gesellschaft, prepared for presentation at AIChE Spring National Meeting, Atlanta, Apr. 1994, Paper #23c, pp. 193-228.

*Primary Examiner* — Charles Bushey
(74) *Attorney, Agent, or Firm* — Brent R. Knight; Gerard J. Hughes

(57) ABSTRACT

A process and apparatus are provided for cooling gaseous effluent from a hydrocarbon pyrolysis furnace, the cooling conduit apparatus including: (i) an inner wall for contacting the effluent, the inner wall defining a bore extending a length of the cooling conduit, the inner wall including a perimeter opening along the bore; (ii) an outer wall external to the inner wall and substantially coaxial to the inner wall; (iii) a substantially annular cavity external to the inner wall and including at least a portion of the outer wall, the annular cavity fluidly and remotely connected to the perimeter opening, the annular cavity externally surrounding a perimeter of the inner wall, the annular cavity including at least a portion of the outer wall; and (iv) a peripheral channel extending around a perimeter of the inner wall, the peripheral channel providing a channel flow path that fluidly connects the annular cavity with the remotely connected perimeter opening along the perimeter of the inner wall.

11 Claims, 3 Drawing Sheets

U.S. PATENT DOCUMENTS

| | | | | |
|---|---|---|---|---|
| 3,907,661 | A | 9/1975 | Gwyn et al. | |
| 3,959,420 | A | 5/1976 | Geddes et al. | |
| 4,054,424 | A | 10/1977 | Staudinger et al. | |
| 4,107,226 | A | 8/1978 | Ennis, Jr. et al. | |
| 4,121,908 | A | 10/1978 | Raab et al. | |
| 4,233,137 | A | 11/1980 | Ozaki et al. | |
| 4,279,734 | A | 7/1981 | Gwyn | |
| 4,444,697 | A | 4/1984 | Gater et al. | |
| 4,457,364 | A * | 7/1984 | DiNicolantonio et al. | 165/134.1 |
| 4,614,229 | A | 9/1986 | Oldweiler | |
| 4,761,077 | A | 8/1988 | Werner | |
| 4,902,303 | A | 2/1990 | Den Bleyker | |
| 4,954,147 | A * | 9/1990 | Galgon | 95/263 |
| 6,019,818 | A | 2/2000 | Knapp | |
| 6,626,424 | B2 | 9/2003 | Ngan et al. | |
| 7,763,162 | B2 | 7/2010 | Strack | |
| 8,074,973 | B2 * | 12/2011 | Spicer et al. | 261/153 |

FOREIGN PATENT DOCUMENTS

| | | |
|---|---|---|
| GB | 1 233 795 | 10/1968 |

* cited by examiner 117
128
132
100
116
110
102
108
106
122
126
134
127
120
130
136
112
124

METHOD AND APPARATUS FOR COOLING PYROLYSIS EFFLUENT

CROSS REFERENCE TO RELATED APPLICATIONS

This application is a divisional of and claims priority and benefit of U.S. application Ser. No. 11/866,175, filed Oct. 2, 2007, now U.S. Pat. No. 8,074,973, the disclosure of which is fully incorporated herein by reference.

FIELD OF THE INVENTION

The present invention is directed to a process for quenching the gaseous effluent from hydrocarbon pyrolysis units, including pyrolysis units using liquid feeds such as naphthas, and especially those units that use feeds that are heavier than naphthas, such as gas-oil or other heavy hydrocarbon feeds. More particularly, the invention pertains to quenching the cracked hydrocarbon effluent below the effluent dew point, using direct quench or indirect heat exchange, wetted-wall quenching apparatus and process.

BACKGROUND OF THE INVENTION

It is desirable to produce light olefins (e.g., ethylene, propylene, and butenes) by cracking relatively heavy hydrocarbon feedstocks, such as gas-oils and crudes, utilizing pyrolysis or steam cracking. It is also required that the cracked effluent stream is quenched or cooled shortly after leaving the pyrolysis furnace to prevent the cracking reactions from continuing past the point of product generation. Quenching effluent streams from cracked heavy hydrocarbon feed presents special challenges to prevent deposition of tar (including tar-precursors and other heavy components) and related fouling problems within the quench equipment. Further, it is desirable to improve steam cracking process efficiency by indirect heat exchange and reuse of heat recovered from the cracked effluent stream. Effluent heat recovery is typically performed by indirect heat exchange, such as with one or more transfer line exchangers (TLE's).

Hydrocarbon feed is heated rapidly during cracking, typically in the presence of steam. After heating and cracking, the vaporized effluent stream may typically exit the pyrolysis furnace at high temperature, such as from about 785° C. (1450° F.) to about 930° C. (1700° F.) and must be rapidly quenched to halt the cracking reactions and prevent degradation of the valuable products. In addition to producing olefins, steam cracking heavier hydrocarbon feedstocks, including feedstocks having aromatic components associated therewith, also produces reactive molecules that tend to combine or polymerize with each other while hot to form higher molecular weight materials known as tar, pitch, or non-volatiles (referred to collectively herein, as tar). Tar is a relatively high-boiling point, viscous, active material that, under certain conditions can deposit on, insulate, plug, and foul heat exchange equipment. The fouling propensity can be characterized in three temperature regimes.

At temperatures above the dew point (the temperature at which the first drop of liquid condenses) of the cracked furnace effluent, the fouling tendency is relatively low. Vapor phase fouling is generally not an issue as there is no liquid or condensates present that could cause fouling or polymerize. Appropriately designed transfer line heat exchangers operating in this regime may quench and remove heat with minimal fouling by limiting the amount of cooling affected to maintain the effluent in the vapor phase.

Below the stream dew point, steam cracked tar condenses from the effluent stream and the fouling tendency may be relatively high, particularly at and immediately downstream of the location where the dew-point is reached. In some applications, as additional materials subsequently condense, there may be sufficient low-viscosity liquids present to flux or carry away the high molecular weight tar molecules. In this regime, the heaviest components in the stream condense but remain hot enough to remain reactive and sustain dehydrogenation and polymerization reactions, undesirably forming higher molecular weight tar molecules. The tar condensates tend to adhere to inner surfaces of process equipment, such as in the TLE's. Furthermore, this material adheres to surfaces and continues to polymerize, dehydrogenate, thermally degrade, and harden, thus making it difficult to remove.

At or below the temperature at which tar is fully condensed, the fouling tendency is relatively low, due to depressed thermal activity and due to the presence of sufficient condensates to act as solvent to keep the tar flowing in the liquid phase. In this regime, the condensed material is still hot enough and fluid enough to flow readily at the conditions of the process but fouling is generally not a serious problem. Phase separation and fractionation becomes key objectives at this stage, to separate the tar and liquids from the more valuable vaporized effluent that comprises the olefin products.

In view of condensation-related fouling and equipment build-up, cracked gas oil and cracked heavy hydrocarbon effluent streams, including some cracked naphtha effluent streams, cannot easily be cooled directly to a desirable processing temperature range, such as from 230° C. to about 300° C. (450° to 570° F.), due to the presence of the condensable tar components. To mitigate tar deposition and prevent fouling, it is known to provide quench fluid injection for direct introduction of a cooling direct quench fluid, directly into the hot effluent stream and/or on the effluent through bore. Direct quench is commonly performed by introduction of the direct quench fluid into the effluent through bore, typically onto both the effluent through bore wall and within the effluent stream, and is dispersed through gravity, fluid shear, and/or mechanical dispersion during introduction. Direct quench is also commonly conducted by dispersing the direct quench fluid directly onto the bore wall. A direct quench cooling process primarily cools by direct mixing and contact of the direct quench fluid with the effluent, such that the direct quench fluid absorbs heat from the hot effluent and may additionally include quench fluid evaporation, both from the bore wall and from within the stream flow path. As the effluent cools, some components therein may condense and replace a portion of the vaporized quench fluid. This direct quench process serves primarily to reduce the temperature by heat transfer to and by at least partial evaporation of the quench fluid. If sufficient volume of quench fluid is introduced, some of the fluid may remain in the liquid phase, depending of course upon the final boiling point of the direct quench fluid, and the direct quench fluid may act as a carrier for the condensed components and simultaneously coat/wet the inner surface of the quench exchanger with quench liquid and thereby prevent accumulation of fouling tar, coke, and precipitates on equipment surfaces.

Significant drawbacks to such direct-quench systems are the high required direct quench fluid injection volume and the corresponding high separation and treatment volumes and costs. It is common for such systems to introduce in excess of three to four mass units of quench fluid per mass unit of process effluent. Pipe sizing must be increased to accommodate such volumes. On commercial sized crackers, this can result in undesirably large circulation pumps, pipe work, cost, and energy consumption. Further, due to the difficulty in controlling the physical dispersion of the injected quench fluid within the cracked effluent stream and equipment process surfaces, not only are large amounts of quench fluid used, but the introduction systems also may utilize inertial dispersion, spraying, or some other type of voluminous and energetic introduction method to attempt adequate dispersion and mixing to directly quench the cracked effluent stream. An additional and serious operation problem with dispersion fittings is the propensity of the small openings in the nozzles to plug with polymer and coke particles.

Separate from direct fluid quench, another means of quenching hot effluent is with an indirect heat exchanger, such as a TLE, either with or without concurrent direct quench injection, though typically without express creation of a wetted-wall quench fluid film. The art has desired production of a wetted wall indirect heat exchanger quench process but has had difficulty actually achieving a commercially effective and efficient process or apparatus. Whereas with the previously discussed direct quench apparatus, a wetted wall film may contribute at least partially to quenching the effluent stream, the role of a wetted wall quench film in an indirect heat exchange apparatus is primarily to mitigate fouling, while merely acting as a medium to transfer heat from the effluent stream to the indirect cooling medium in a cooling jacket that is exterior to the effluent conduit. In an indirect heat exchange process, the coolest region is close to the bore walls and as such, foulants tend to accumulate on the cool walls. The wet surface film is desired to act primarily as an impediment to foulant deposition and as a carrier for removal of condensates and tar precursors from the system, which might form either due to condensation within the effluent stream, or from effluent proximity to the relatively cooled effluent bore wall. The difficulty, however, has been in affecting comprehensive heat exchanger wall film coverage over the full circumference and length of the exchanger in the presence of a shearing, hot, gaseous effluent flow. Not only has the problem been difficult to achieve, it has been even more difficult to do so efficiently. The known indirect heat exchange quench systems that attempt to utilize a wetted wall process are inefficient and commercially deficient for the intended purpose, requiring introduction of undesirably excessive amounts of quench fluid.

The article "Latest Developments in Transfer Line Exchanger Design for Ethylene Plants", H. Herrmann & W. Burghardt, Schmidt'sche Heissdampf-Gesellschaft, prepared for presentation at AIChE Spring National Meeting, Atlanta, April 1994, Paper #23c, discloses dew point fouling mechanisms in ethylene furnace quench systems, as well as use of heat exchangers that generate high pressure steam, e.g., a quench exchanger followed by a quench fluid injection fitting. However, need for process and equipment improvements remain.

U.S. Pat. Nos. 4,107,226; 3,593,968; 3,907,661; 3,647,907; 4,444,697; 3,959,420; 4,121,908; and 6,626,424; and Great Britain Patent Application 1,233,795 disclose various dry wall, sequential dry wall, and direct quench, and quench fluid direct injection fittings, applications, including annular introduction fittings. These references also disclose various methods of distributing wash liquids in annular quench fittings. U.S. Pat. No. 3,593,968 discloses a method and apparatus for direct oil quench point, with no heat recovery to another medium. Also, under actual operating conditions and manufacturing variations, the severe temperature differences of the various components, heat stresses, and repeated heating and cooling cycles create difficulties in creating and maintaining a uniform film coverage and thickness. These deficiencies resulted in utilization of excessive amounts of quench fluid to maintain operational effectiveness. Other attempted improvements followed in the art. In U.S. Pat. No. 3,959,420, the same inventor provided an improved annular quench fitting that reversed the position of some of the quench fluid discharge components as compared to the '968 patent, providing a method and apparatus similar to a spill-over or weir apparatus to control flow of the quench fluid. The operational effectiveness of such design tends to be subject to equipment alignment and manufacturing variances and also requires excessive quench fluid flow rates to overcome the deficiencies. The '420 design also requires additional components and complexity, such as a baffle and introduction of an inert gas in a purge gas chamber. Differential movement and distortion between the abutting sections of the injector can adversely affect the quench oil injection pattern and is not effective for quench to feed mass ratios of less than about 2.0. Further improvements continued to be sought in the industry.

U.S. Pat. No. 4,121,908 teaches use of tangential introduction of liquid quench fluid in attempt to utilize inertial energy to disperse the direct quench fluid circumferentially on all surfaces of the quench bore. Again however, this process also requires use of an inefficiently large quantity of combined quench fluid, as the liquid quench fluid is introduced into the bore along with a direct quench fluid into the same bore that conveys the gaseous effluent. Further, the apparatus of the '908 patent possesses areas along the quench tube bore that are subject to fouling tar build-up, including the tube areas opposite the locations of introduction of the liquid quench fluid. The apparatus of the '908 invention also cannot produce a uniform liquid quench film at the desired low quench fluid rates or ratios.

U.S. Pat. No. 4,444,697 discloses a direct quench fitting and teaches use of tangential introduction of direct quench fluid directly into the effluent through bore, using multiple openings in an attempt to provide full quench fluid film coverage and concurrent dissipation for direct quenching. However, the tangential quench oil distribution and introduction is performed in an annular cavity that performs both distribution within the cavity and direct introduction into the through bore. The arrangement directs a substantial portion of quench fluid immediately into the effluent through bore from the slots nearest each point of introduction of quench fluid into the cavity. There is insufficient hydraulic control of the introduced quench fluid. To distribute quench fluid to other slots requires introduction of an inefficient volume of quench fluid and disproportionate distribution of quench fluid on the bore circumference. The annular, multiple introduction slot arrangement fails to adequately control distribution of quench fluid about the full length of the annular cavity, by permitting excessive introduction nearest the quench fluid source with dissipating rates through the length of the annular cavity. Also, as with many of the preceding designs, the tangential quench fluid introduction ports are also inefficiently designed, creating discontinuous fluid introduction into the bore, leading to areas of foulant formation. Further, the fluid inlet ports are positioned to direct quench fluid directly at a few of the inlet slots, further contributing to inefficient performance. Still further improvements were needed.

U.S. Pat. No. 6,626,424 discloses a method for quenching a hot effluent stream by injecting a quenching fluid tangentially, directly into the hot gas stream with sufficient inertia and momentum to cause the quench fluid to flow circumferentially around the inside surface of the conduit. However, quench fluid introduction systems such as disclosed in the '424 patent and others listed above that introduce the quench fluid directly into the effluent conduit from a single point or from a discrete number of points require an inefficient volume of quench fluid. Also, computer modeling has demonstrated that separated phase flow patterns or regimes tend to establish along the flow path as the volume of quench fluid is reduced to desirably efficient levels, requiring use of an inefficient volume of fluid to obtain suitable surface coverage over the full length of the TLE. Also, quench introduction fittings tend to be sized to operate around a target flow range and if the effluent flow diverges out of this flow range, then the fitting is either inefficiently over-sized or under-sized. To avoid these issues, such systems tend to require introduction of an excessive volume of quench fluid to overcome the non-uniformity and dispersional inefficiencies. Further, a significant portion of the quench fluid is introduced in such manner as to directly and transversely encounter the high velocity cracked effluent stream, resulting in turbulent dispersion within the flow stream and mitigated interaction with tube process surfaces. This tends to result in substantial portions of the introduced quench fluid inefficiently not encountering and not protecting the inner process wall. To mitigate the turbulent dispersion effect, an excessive volume of quench fluid is introduced to improve surface coverage efficiency. Again, this also requires increased processing equipment capacity.

The prior art demonstrates that the processes and apparatus for introducing a wall-wetting quench fluid via the known quench fittings and processes have efficiency shortcomings and often produce less than optimal quench results. The prior art leaves room for further process and equipment improvements to achieve the desired operational efficiency and effectiveness in a quench system for quenching a tar-bearing cracked effluent while mitigating tar buildup on the process surfaces of the quench tube.

It remains desirable to provide an improved quench fluid introduction method and apparatus that more efficiently, uniformly, and conservatively distributes an efficient amount of quench fluid along the effluent through bore. It is desirable to provide a wet wall quench system that is useful with a direct quench system and/or an indirect heat exchange system, that also effectively uses substantially less quench fluid than prior art systems to prevent tar buildup. Further, it is desirable to reduce the amount of quench fluid required to effectively coat the quench apparatus effluent through bore surfaces. It is desired to provide an effective, comprehensive, wetted wall quench fluid film that uses less quench fluid than is required by the prior art processes.

SUMMARY OF THE INVENTION

The present invention relates to a process and related apparatus for cooling a gaseous pyrolysis effluent containing condensable components that can deposit on effluent-contacting surfaces, such as indirect quench fittings and/or indirect heat exchanger lines. The inventive processes and apparatus have application to wetted wall direct quench systems and to wetted wall indirect heat exchange systems, such as transfer line exchangers (TLE's). This invention may be useful with primary, secondary, and/or tertiary quench systems. The invention has particular application for equipment and processes used to quench a hot, cracked, gaseous effluent containing condensable tar-precursors, such as may result from cracking a liquid hydrocarbon feed such as gas-oil, naphtha, or feeds having a significant aromatic content. Provided are substantial improvements in system efficiency and performance that are realized at least in part by providing a process and apparatus that segregates the operation of introducing the liquid quench fluid into an annular quench fluid cavity and distributing that fluid within the cavity, from the operations of displacing or introducing the quench fluid from the cavity onto the effluent through bore walls.

The inventive apparatus and process breaks the quench fluid introduction process into hydraulically distinct steps, including the steps of introducing the wet wall forming liquid quench fluid into the annular cavity that are hydraulically remote from the steps of introducing the quench fluid onto the gaseous effluent wall. The invention provides method and means to efficiently and effectively provide a uniform liquid quench film without requiring an undesirable excess of liquid quench fluid, as compared to the prior art. The inventive process and apparatus provide an efficient and effective method and means for directly introducing liquid quench fluid, preferably liquid quench oil, into an indirect heat exchanger, such as a TLE, or into a direct quench fitting. This process is enabled at least in part due to the presence of an annular cavity that is hydraulically in controlled communication with (e.g., remote or restricted from) the effluent through bore. The inventive process is further enabled at least in part by the method of introduction of liquid quench fluid into the annular cavity. The inventive process is still further enabled at least in part due to the provision of a peripheral channel that serves to create the controlled hydraulic resistance between the annular cavity and the effluent through bore that facilitates a momentary retention and distribution of quench fluid and fluid pressure within the annular cavity prior to uniform displacement of the liquid film onto the effluent through bore, in a continuous process.

In one aspect, the invention includes a process for cooling gaseous effluent from a hydrocarbon pyrolysis furnace, the process comprising: (a) introducing the gaseous effluent into a cooling conduit, the cooling conduit comprising; (i) an inner wall for contacting the effluent, the inner wall defining a bore extending a length of the cooling conduit, the inner wall including a perimeter opening along the bore; (ii) an outer wall external to the inner wall and substantially coaxial to the inner wall; (iii) a substantially annular cavity external to the inner wall and including at least a portion of the outer wall, the annular cavity fluidly and remotely connected to the perimeter opening, the annular cavity externally surrounding a perimeter of the inner wall, the annular cavity including at least a portion of the outer wall; and (iv) a peripheral channel (referred to herein as a "channel") extending around an outer periphery or perimeter of the inner wall, the peripheral channel fluidly connecting the annular cavity and the perimeter opening, along the perimeter of the inner wall; (b) introducing a liquid quench fluid through a liquid quench fluid introduction port tangentially into the cavity, substantially along the first portion of the outer wall, whereby the introduced liquid quench fluid fills the cavity; (c) passing the introduced liquid quench fluid from the annular cavity through the channel to the perimeter opening along a channel flow path; and (d) passing the liquid quench fluid from the perimeter opening onto the inner wall for distribution of the quench fluid along at least a portion of the length of the inner wall as a quench fluid film, while concurrently passing the gaseous effluent along the bore of the cooling conduit to produce a cooled gaseous effluent stream.

In another embodiment, the invention further comprises the step of cooling the gaseous effluent below its initial dew point, while the gaseous effluent is passed along the bore and recovering the cooled gaseous effluent product. In one embodiment, the channel may extend peripherally around a portion or portions, e.g., continuously or discontinuously, of a perimeter of the conduit through bore. Depending upon the mechanical design, the channel could be rendered discontinuous such as by mechanical support members interrupting the otherwise preferable continuous nature of the channel opening. It is most preferred that the channel extends uninterrupted, peripherally around a full circumference of the conduit through bore, as a continuous channel in the wall of the cooling conduit. It is also preferable that the bore and annular cavity are each substantially circular when viewed in cross-section along the direction of flow.

In another embodiment, the invention includes the step of quenching the gaseous effluent using an indirect heat exchange fluid in a heat exchange fluid annulus exterior to the inner wall and downstream of a perimeter opening to the through bore for the liquid quench fluid. In a preferred embodiment, the cooling conduit further comprises a heat exchange fluid jacket for maintaining the indirect heat exchange fluid in contact with an external side of the inner wall, and the jacket comprises a heat exchange fluid inlet and a heat exchange fluid outlet for fluid circulation through the jacket annulus.

According to one embodiment of the invention, the quenched gaseous effluent mixture is recovered from the cooling conduit effluent outlet at a temperature that is below the dew point of the effluent stream. Cooling or quenching may be affected by either a direct quench fitting quench process that is supplemented with the inventive wetted wall process, with a direct quench process that also serves to provide the wetted wall, and/or with an indirect heat exchange cooling process that is supplemented with the inventive wetted wall process. In another aspect, the invention includes a process for cooling gaseous effluent from a hydrocarbon pyrolysis furnace, using a wetted wall liquid film, the process comprising: (a) introducing the gaseous effluent into a quench exchanger, the quench exchanger comprising; (i) an inner wall for contacting the effluent, the inner wall defining a bore extending a length of the cooling conduit, the inner wall including a perimeter opening along the bore; (ii) an outer wall substantially coaxial to the inner wall; (iii) a substantially annular cavity external to the inner wall, the annular cavity fluidly and remotely connected to the perimeter opening, the annular cavity externally surrounding the inner wall, the annular cavity including at least a first portion of the outer wall; and (iv) a peripheral channel extending around the perimeter of the inner wall, the channel fluidly connecting the annular cavity and the perimeter opening, along the perimeter of the inner wall, the channel including another portion of the outer wall; (b) introducing a liquid quench fluid through a liquid quench fluid introduction port tangentially into the cavity, substantially along the first portion of the outer wall, whereby the introduced quench fluid fills the cavity; (c) passing the introduced liquid quench fluid from the annular cavity through the channel along a channel flow path having a first directional component that is substantially parallel to the direction of effluent flow through the bore and another directional component that is radially inward from the outer wall toward the inner wall; (d) passing the quench fluid from the channel onto the inner wall for distribution of the quench fluid along at least a portion of the length of the inner wall as a quench fluid film, while concurrently passing the gaseous effluent along the bore of the cooling conduit; and (e) introducing a heat exchange fluid through a heat exchange fluid inlet and into a quench annulus between the quench exchanger tube and a heat exchange fluid jacket exterior to the quench exchanger tube, the heat exchange fluid jacket maintaining the heat exchange fluid in contact with an exterior side of the quench exchanger tube. A heat exchange jacket may include more than one effluent conduit, such as in a shell-and-tube type heat exchanger. In another embodiment, the step of displacing the liquid quench fluid further comprises displacing the liquid quench fluid radially inward from the annular cavity toward the bore flow path and onto the internal process surface of the quench exchanger tube.

In still another aspect, the invention includes a cooling conduit apparatus for cooling gaseous effluent from a hydrocarbon pyrolysis furnace, the cooling conduit apparatus creating a wetted wall quench apparatus, and the cooling conduit apparatus comprising: (i) an inner wall for contacting the gaseous effluent, the inner wall defining a bore extending a length of the cooling conduit, the inner wall including a perimeter opening along the bore; (ii) an outer wall external to the inner wall and substantially coaxial to the inner wall; (iii) a substantially annular cavity external to the inner wall and including at least a portion of the outer wall, the annular cavity fluidly and remotely connected to the perimeter opening, the annular cavity externally surrounding a perimeter of the inner wall, the annular cavity including at least a first portion of the outer wall; (iv) a peripheral channel extending around a perimeter of the inner wall, the peripheral channel providing a channel flow path that fluidly connects the annular cavity with the remotely connected perimeter opening along the perimeter of the inner wall; and (v) a liquid quench fluid introduction port for introducing the liquid quench fluid into the annular cavity.

Further, the cooling conduit may comprise an indirect heat exchange fluid jacket for maintaining the indirect heat exchange fluid in contact with an external side of the inner wall, the jacket comprising an indirect heat exchange fluid inlet and an indirect heat exchange fluid outlet. The apparatus may be used as a primary, secondary, or tertiary quench exchanger.

DETAILED DESCRIPTION OF THE INVENTION

Figure 1:
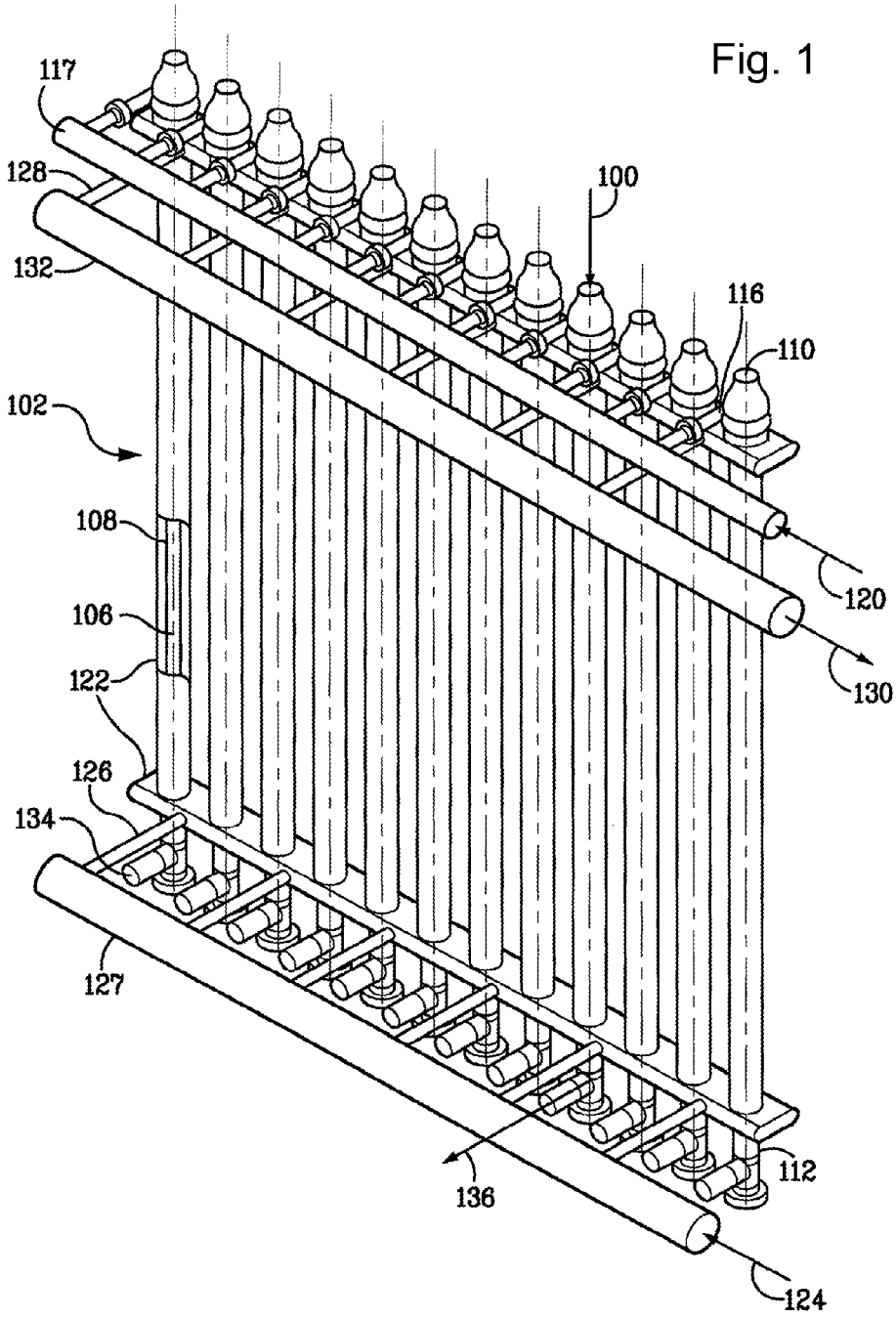
FIG. 1 is a perspective diagram illustrating a manifolded bank of indirect heat exchange type quench exchangers for treating gaseous effluent from pyrolysis cracking, according to one example of the present invention.

The present invention provides a process and apparatus for cooling the gaseous effluent stream from a hydrocarbon pyrolysis reactor while mitigating heat exchanger fouling and permitting heat recovery and re-use. The cooled effluent may be further processed for separation and recovery of desired pyrolysis products, such as olefin and/or aromatic products. The inventive wet-wall cooling (quenching) process provides a novel process and apparatus for introduction of wet-wall forming liquid quench fluid onto the effluent through bore wall surface, according to a process that applies the quench fluid to the inner wall of the quench exchanger or cooling conduit, without undesirably dispersing excess liquid quench fluid into the effluent stream. In a most basic form, the inventive process provides a step of introducing the liquid quench fluid into an annular cavity in a fashion so as to achieve uniform distribution of the fluid about the circumference of the effluent bore. The annular cavity is hydraulically restricted, that is, hydraulically segregated or remote from, but still in fluid communication with the effluent through bore. Preferably the liquid quench fluid is introduced into the annular cavity with an inertial energy that facilitates complete and uniform circumferential distribution and pressurization within the annular cavity, about the perimeter of the effluent through bore. Subsequently, the inventive apparatus and method convey the liquid quench fluid from the annular cavity to the effluent through bore, via a connective channel or slot that also functions to provide hydraulic impediment or resistance to fluid exiting from the annular cavity, so as to maintain the full volume of the annular cavity substantially full of quench fluid and substantially equally pressurized around the full course of the annular cavity, respecting of course, pressure differences and gradients due to fluid kinetics. Thereby, a uniform and controlled supply of quench fluid is introduced at a perimeter opening to the effluent through bore with sufficiently low energy level as to avoid dispersing or losing the quench fluid into the core of the hot, fast effluent stream due to fluid shear or other dispersion. The liquid quench fluid can then efficiently and uniformly distribute from the perimeter opening, along the inner wall of the effluent through bore, providing an effective, efficient, uniform quench film. The inventive process and apparatus may have applicability with substantially any quench process that utilizes an introduced quench fluid film on the effluent through bore wall, such as a wet-wall assisted primary direct quench fitting, or a wet-wall secondary and/or tertiary indirect heat exchange quench exchanger.

Unless otherwise stated, all percentages, parts, ratios, etc. are by weight. Unless otherwise stated, a reference to a compound or component includes the compound or component by itself, as well as in combination with other compounds or components, such as mixtures of compounds. Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

Exemplary hydrocarbon pyrolysis feedstocks that may have particular applicability for use in the present invention typically comprises one or more liquid hydrocarbon feedstocks such as naphthas, gas oils, kerosene, heating oil, diesel, hydrocrackate, Fischer-Tropsch liquids, distillate, heavy gas oil, steam cracked gas oil and residues, crude oil, crude oil fractions, atmospheric pipestill bottoms, vacuum pipestill streams including bottoms, heavy non-virgin hydrocarbon streams from refineries, vacuum gas oils, low sulfur waxy residue, heavy waxes, atmospheric residue, and heavy residue and further comprises salt and/or particulate matter.

Although the inventive process may be used to quench an effluent stream generated by substantially any cracked hydrocarbon feedstock, particularly suitable hydrocarbon feedstocks include feeds typically having a final boiling point in a temperature range from at least about 90° C. or even more preferably from about 180° C., or higher. Particularly typical feeds may include liquid hydrocarbons that are heavier than light naphtha or feeds that have a relatively high aromatic content, thus leading to substantial tar precursor yields. Exemplary feeds may also include those boiling in the range from about 90° C. to about 650° C. (from about 200° F. to about 1200° F.), say, from about 200° C. to about 510° C. (from about 400° F. to about 950° F.). The temperature of the gaseous effluent at the outlet from the pyrolysis reactor is typically in the range of from about 760° C. to about 930° C. and the invention provides a method of ultimately cooling the effluent to a temperature at which condensates are produced within the effluent stream.

The present application expressly incorporates herein by reference the entire disclosure of U.S. Patent Publication No. 2007/0007169 A1.

The present invention particularly relates to a method for directly and/or indirectly quenching the gaseous effluent from the liquid hydrocarbon thermal cracking unit, preferably a steam cracking unit, using a wetted wall quench apparatus. An exemplary cooling method typically comprises passing the effluent through at least one primary cooling unit, such as a primary quench fitting or primary exchanger that also utilizes indirect heat exchange (primary TLE), which recovers heat from the effluent, cooling the effluent to a desired temperature, such as just above the temperature at which condensation and fouling are incipient. Alternatively, the primary quench process may include the inventive wetted wall process and optionally in conjunction with a direct oil quench injection fitting, whereby the majority of the cooling is provided by the direct quench injection and the wetted wall prevents condensate fouling.

An application for the inventive process may also cool the gaseous effluent in the primary quench fitting or TLE, such as to a temperature that is either just above or below the effluent dew point, and may also utilize secondary and/or tertiary quench to further cool the effluent below the effluent dew point. Conventional indirect heat exchangers, such as double-tube, tube-in-tube type TLE exchangers, shell and tube exchangers, fan-cooled, or other indirect heat exchangers may be used in indirect heat exchange applications. A primary heat exchanger may, for example, cool the process stream to a temperature between about 340° C. and about 650° C. (645° F. and 1200° F.), such as about 370° C. (700° F.), using saturated boiler feed water and steam as the indirect cooling medium, typically at pressures from about 4240 kPag (600 psig) to about 13,800 kPag (2000 psig). In other applications, the primary quench may be affected by a direct quench fitting in conjunction with a wetted wall produced according to the present invention that does not substantially utilize indirect heat exchange. Further cooling may be provided in secondary and/or tertiary heat exchangers that utilize indirect heat exchange and may also use a wetted wall process that is affected according to the subject inventive process and apparatus.

On leaving the primary heat exchanger, the primary-cooled gaseous effluent may still be at a temperature above the effluent's hydrocarbon dew point (the temperature at which the first drop of liquid condenses). For a typical heavy feed under certain cracking conditions, the hydrocarbon dew point of the effluent stream may range from about 340° C. to about 650° C. (650° F. to 1200° F.), say, from about 400° C. to about 600° C. (750° F. to 1100° F.). Above the hydrocarbon dew point, the fouling tendency is relatively low, i.e., vapor phase fouling is generally not severe and there is typically little to no liquid present that could cause fouling. Tar (including tar-precursors) is commonly substantially fully condensed from heavy feeds at a temperature ranging from about 200° C. to about 350° C. (400° F. to 650° F.), say, from about 230° C. to about 315° C. (450° F. to 600° F.), e.g., at about 290° C. (550° F.). The primary heat exchanger (commonly a double tube, dry-wall quench exchanger) may also serve as a high pressure steam superheater, e.g., of the type described in U.S. Pat. No. 4,279,734. Alternately, the dry-wall quench exchanger can be a high pressure steam generator.

According to one aspect of the inventive process, after leaving the primary heat exchanger the gaseous effluent is preferably passed to at least one secondary heat exchanger that further cools the gaseous effluent, such as to a temperature below its dew point. The inventive process includes a wetted cooling conduit wall to prevent or mitigate deposition of condensed tar compounds on that inner wall. The through bore wall is wetted with a liquid film that is introduced by direct introduction of a liquid quench fluid according to the present invention. In some processes, wetting may be enhanced or supplemented by in situ liquid generation, such as by direct injection of a direct quench fluid, and/or by condensation of components of the quenched effluent stream that are condensed by either or both of direct injection quenching and/or indirect quench fluid cooling. The wetted wall exchanger of the present invention thus may also include indirect heat exchange means for supplemental cooling and indirect heat recovery, such as an annular cooling jacket, e.g., a double tube arrangement heat exchanger, a shell and tube exchanger, a transfer line exchanger (TLE), or other indirect heat exchanger arrangement, to further cool the effluent stream. For a wetted wall TLE with indirect heat exchange, the quench fluid film may act as a washing solvent to prevent fouling and additionally as a heat transfer medium to facilitate heat transfer from the effluent stream, through the quench fluid, across the exchanger tube wall and into the indirect quench medium, such as steam or water.

The temperature of the quench fluid at introduction into the effluent stream is preferably at or below the temperature at which entrained tar components are fully condensed, typically at about 200° C. to about 290° C. (400° F. to 550° F.), such as at about 260° C. (500° F.). Thereby, tar precursor condensation is substantially completed within the exchanger through bore before the effluent leaves the exchanger. The tar precursor condensation must be totally complete before leaving the exchanger, or the device can foul. Preferably, the quench fluid film effectively maintains the heat exchange surface wet with quench fluid as the effluent stream is cooled along the through bore, thus preventing tar deposition and fouling on the heat exchange process surface. The wetted exchanger should cool the effluent stream to below the temperature at which tar is produced. If the cooling is stopped before this point, fouling is likely to occur further downstream because the process stream would still be in the fouling regime.

In addition to use with direct quench systems, indirect heat exchange, such as a water jacket, may be used with the inventive wetted-wall quench exchangers and processes. Indirect heat exchange may be used to recover and reuse effluent heat, using water or steam as a heat recovery medium to feed a high pressure steam generator or as a high pressure boiler feed water preheater. The use of a high pressure boiler feed water preheater in the quench system allows energy to be recovered at temperatures below 287° C. (550° F.), thus indirectly contributing to the generation of valuable high pressure steam.

Prior art direct quench fittings or processes typically operate with a direct quench fluid to furnace feed weight ratio of at least 1.0 and commonly greater than 2.0 and commonly even greater than 4.0, depending upon the heat duty required to obtain the desired cooling effect. (The term "furnace feed" refers to the hydrocarbon feed component that is fed to the radiant section of the furnace, not including any added steam.) Typically, quench fluid to furnace feed ratios of less than about 2.0 were not used in the prior art commercial applications as such rates were known to be incapable of effectively creating an effectively wetted wall. However, even at such relatively high quench fluid rates, fouling can still sometimes occur in a direct quench apparatus due to deficient foulant protection and removal. The most efficient of known prior art wetted wall direct quench systems typically required a wall-wetting liquid quench fluid to furnace feed ratios of from about 2.0 to about 4.0 to reliably affect film coverage. The function of the wet wall film in a direct quench process is both to (i) prevent and remove foulant buildup and (ii) to cool the gaseous effluent stream by direct contact therewith. The high combined direct and wall wetting quench fluid rates thereby created excessive volumes of total quench fluid in the effluent stream. Thus, the prior art direct quench systems were in want of improved efficiency.

Similarly, prior art indirect heat exchange quench systems have also been in need of a process that efficiently provides a wetted wall to mitigate and remove foulant buildup on the relatively cool effluent through bore wall. However, in practice, wetted wall indirect heat exchange systems have not found commercial success, even with inefficient rates. Typically, the diameter of effluent through bores in indirect heat exchange systems is much smaller than the effluent through bores of direct quench systems, thereby experiencing increased dynamic effects caused by any introduced fluid in the indirect heat exchange systems. Direct quench systems may, for example, provide an effluent through bore having from about 8 to 10 inch internal diameter, and an indirect heat exchange quench system may typically have an effluent through bore internal diameter of, for example, from about 2 to 4 inches. Consequently, there is less available capacity for a large loading of wall wetting liquid quench fluid in indirect heat exchange systems and the indirect heat exchange systems become much more sensitive to an increased fluid loading, particularly when the wetted wall system is adding liquid quench fluid at ratios of greater than about 1.0, such as at ratios of from about 1.0 to about 3.0. Thus, improved efficiency and performance in a wetted wall quench system can have significantly favorable overall quench system impact, particularly with regard to use with indirect heat exchange systems.

The present invention provides a much more efficient process and apparatus to create an effectively wetted wall for use with either a direct quench and/or indirect heat exchange type of quench system. The present invention is thus suitable for (i) a stand alone quench or wall wetting system, (ii) supplementing a direct quench system, (iii) a direct quench system, and/or (iv) use with an indirect heat exchange system, with a liquid quench fluid to furnace feed weight ratio of from about 0.1 to about 1.0, if desired. The inventive system may also be used to deliver higher quench fluid to hydrocarbon feed ratios, e.g., greater than 1.0, if desired, such as for use with direct quench systems needing higher rates of direct quench fluid. Any additional quench fluid above the amount needed to wet the wall, including the fluid needed to achieve heat balance, may be introduced separately or in conjunction with the apparatus and process of the present invention. In many applications, the wetted wall system of the present invention can provide an effective, uniform, and comprehensive wetted wall liquid quench fluid film at a liquid quench fluid to furnace feed weight ratio of from about 0.2 to about 0.5. This represents a substantial improvement in total quench system efficiency and performance. Uniform and comprehensive quench film distribution around the entire periphery of the quench tube or effluent through bore becomes especially challenging and important at lower quench fluid rates, particularly at ratios of less than 1.0 and the present invention provides a process and apparatus that is capable of providing such improved performance. The present invention resolves the obstacles that previously necessitated significantly higher wetted wall quench fluid introduction rates and provides process and means to deliver a substantially uniform quench film thickness or density, thereby providing adequate protection to prevent tar or tar-precursor deposition and removal over the full area of the effluent quench system. It is an advantage of the inventive process and apparatus to provide an effective wetted-wall quench exchanger that operates with much lower quench fluid to furnace feed ratios than was previously possible.

In one preferred embodiment, the invention includes a process for cooling a gaseous effluent stream from a pyrolysis furnace by introducing the gaseous effluent into the cooling conduit or more particularly, a quench exchanger type of cooling conduit. The invention includes introducing liquid quench fluid onto an inner surface of a cooling conduit by a process that provides a substantially even rate and volume of quench fluid introduction over the full periphery of the effluent flow stream, and through the conduit. Preferably the quench fluid is introduced to the effluent through bore by substantially uniform fluid displacement from a peripheral quench fluid reservoir or annular cavity that extends around the perimeter of the conduit to feed quench fluid to the introduction channel.

In one aspect of the invention, the gaseous effluent from the pyrolysis furnace flows through a bore extending the length of the cooling conduit. The relevant portion of the bore is typically that portion between the perimeter opening and the conduit outlet or a relevant portion of the bore also that is subject to indirect heat exchange. Although it is preferred that the bore is substantially circular in cross-section and extends axially along the flow path to form a substantially tubular through bore, the cooling conduit may be substantially any cross-sectional geometry, such as oval, rectangular, corrugated, etc. It is also preferable that the cooling conduit through bore is substantially longitudinal and straight along the effluent flow path. However, it is anticipated that the conduit or quench exchanger bore may alternatively contain curves, such as in a U-shaped geometry. The cooling conduit through bore may thus be of substantially any convenient size and shape, but will preferably be linear or straight and oriented in a upright or vertical direction with respect to ground level, such as illustrated in FIG. 1, as complex geometries may become more difficult to uniformly wet after the wetting quench liquid is displaced from the perimeter opening.

The inventive process provides a quench fluid perimeter opening on a peripheral perimeter of the cooling conduit inner wall and a connected channel for conveying the quench fluid from the annular cavity to the effluent bore. Preferably the quench fluid channel is continuous around the full circumference of the inner wall to provide uniform, uninterrupted quench fluid introduction into the effluent stream and onto the full periphery of the inner wall. However, it is recognized that some quench fitting geometries could include support members that bisect the channel, resulting in a slightly discontinuous channel.

The annular cavity is provided exterior to and circumferentially around the perimeter of the effluent through bore for receiving and distributing the quench fluid. The annular cavity should be sized to permit substantially full and uniform distribution of quench fluid and pressure in the quench fluid, around the perimeter of the effluent through bore and avoid areas of irregular or excessive concentration or loss of quench fluid from the annular cavity, with respect to the perimeter of the effluent through bore. Channel geometry and sizing also should be determined so as to create substantially uniform or well distributed pressure within the annular cavity and a slight hydraulic resistance or pressure drop between the annular cavity which receives the quench fluid therein and the effluent through bore. The term "hydraulic resistance" is intended to be defined broadly to include substantially any hydraulic impediment, pressure drop, resistance, or other flow slowing or controlling component. This hydraulic resistance facilitates maintaining the annular cavity substantially completely filled during operation by creating a "hydraulic resistance" or remoteness between the annular cavity and perimeter opening. However, it is also desirable that the quench fluid channel includes sufficient width or gap size to provide sufficient total flow area at the inner wall perimeter opening so as not to cause a pressure drop at the perimeter opening that undesirably produces spraying or other dispersed delivery of the quench fluid into the effluent stream. The quench fluid should flow uniformly from the channel opening (perimeter opening) at the inner wall, facilitating coating the wall in the direction of effluent flow with liquid quench fluid.

Liquid quench fluid preferably enters the annular cavity from a liquid quench fluid introduction port through the wall of the quench apparatus, more preferably at a tangent with respect to the conduit through bore. In one preferred embodiment, the inventive apparatus and process includes use of two fluid introduction ports for introducing quench fluid into the annular cavity. Each of the two fluid introduction ports should be positioned about 180 degrees apart from the other and each oriented to tangentially deliver quench fluid in the same direction as the other respective introduction port. Thereby, the fluid is introduced into the annular cavity in a common direction of rotation about the effluent through bore. Other embodiments may be conceived that utilize additional number of quench fluid introduction ports spaced about the perimeter of the through bore, but such additional ports may be unnecessary, as the inventive apparatus has demonstrated and modeled adequate fluid distribution with either a single or two opposed fluid introduction ports.

As the inventive process and apparatus provide a substantially uniform distribution of quench fluid and pressure on a full perimeter of an effluent through bore wall, if the bore wall ever does begin to foul, the foulant may be removed from the bore wall merely by increasing the flow rate of quench fluid onto the bore wall. For example, the quench fluid rate may be increased by from about ten percent to about one-hundred percent, such as about fifty percent, until the bore is considered cleaned. Similarly, the normal quench fluid flow rate may be adjusted in response to an operational parameter, such as effluent flow rate, effluent discharge temperature, and/or indirect quench fluid temperature. The inventive apparatus should not require steam-air decoking or other violent thermal intervention, as is commonly done to defoul prior art quench equipment.

Figure 2:
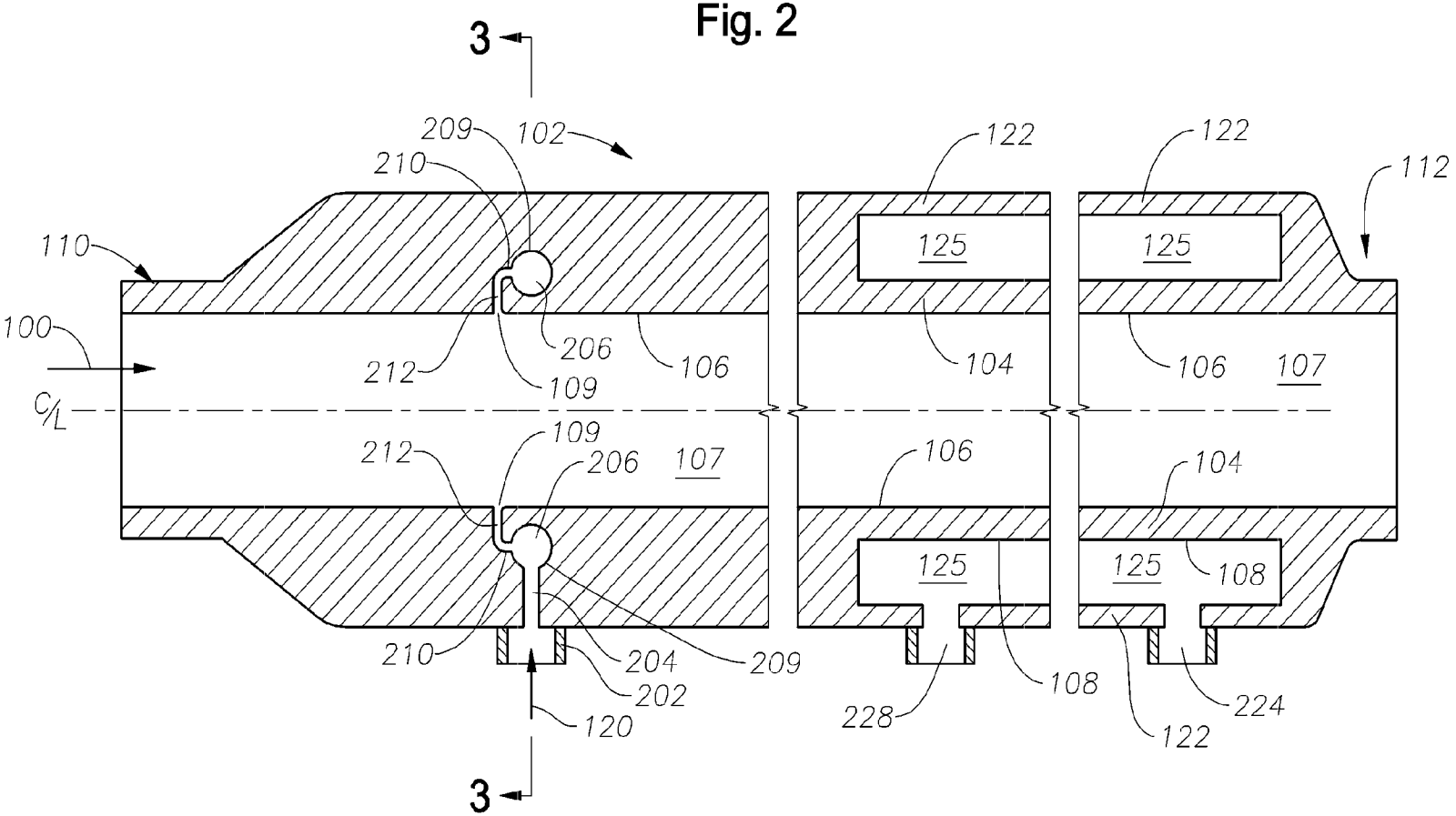
FIG. 2 is a simplified, longitudinal cross-section of a wetted wall, indirect heat exchange cooling conduit, according to one embodiment of this invention, such as may be used with the indirect quench exchanger bank of FIG. 1.

FIG. 1 provides a perspective illustration of an embodiment of the present invention comprising a manifolded bank of indirect heat exchange type cooling conduits for cooling gaseous effluent such as produced by steam cracking, in conjunction with a wall wetting apparatus. FIG. 2 provides a cross-sectional illustration of one embodiment of an exemplary, simplified, liquid washed (wetted wall) heat exchanger that also includes indirect heat exchange to cool the gaseous effluent. Gaseous, tar precursor-containing effluent 100 from a hydrocarbon pyrolysis furnace (not shown), is cooled by introducing the gaseous effluent, such as at a temperature above its dew point, into a quench exchanger cooling conduit 102. In one aspect, the inventive process comprises introducing the gaseous effluent 100 into the cooling conduit bore 107 and then uniformly introducing a liquid quench fluid 120 along the conduit inner wall 106. The cooling conduit 102 comprises (i) an inner wall 106 for contacting the effluent 100, the inner wall 106 defining a bore 107 extending a longitudinal length of the conduit 107, the inner wall including a perimeter opening 109 along the bore and preferably extending uninterrupted around the full perimeter of the bore 107, (ii) an outer wall 209, 210 substantially coaxial to the inner wall 106, (iii) a substantially annular cavity 206 external to the inner wall and including at least a first portion 209 of the outer wall, the annular cavity fluidly and remotely connected to the perimeter opening 109 and the annular cavity externally surrounding the perimeter of the inner wall, the annular cavity 206 including at least a portion 209 of the outer wall 209, 210, and (iv) a peripheral channel 212 extending around the perimeter of the inner wall 106, the peripheral channel 212 fluidly connecting the annular cavity 206 and the perimeter opening 109 at the inner wall 106, preferably the channel 212 including another portion 210 of the outer wall 209, 210. The process also includes the steps of (b) introducing a liquid quench fluid 120 tangentially into the annular cavity 206 of the cooling conduit 102, substantially along the first portion 209 of the outer wall, whereby the quenching fluid 120 fills and pressurizes cavity 206 and (c) passes the introduced liquid quench fluid from the annular cavity through the channel 212 to the perimeter opening, along a channel flow path 212; and (d) passes the liquid quench fluid 120 from the perimeter opening 109 onto the inner wall 106 for distribution of the quench fluid 120 along at least a portion of the length of the inner wall 106 as a quench fluid film, while concurrently passing the gaseous effluent 100 along the bore 107 of the cooling conduit 102 to produce a quenched gaseous effluent stream. Channel 212 may be of substantially any shape but is preferably be a peripheral gap or slot type of aperture or either uniformly tapered or relatively constant gap width, with respect to the radially inward direction from the outer wall 209 to the peripheral opening 109. Channel 212 provides at least some hydraulic resistance or impedance to flow of liquid quench fluid from the annular cavity 106 to the peripheral opening 109. The amount of hydraulic resistance need not be great, but merely only enough to discourage premature or nonuniform liquid quench fluid loss from the annular cavity into the effluent through bore. The hydraulic resistance need only provide enough impedance to facilitate uniform distribution and substantially uniform pressurization of liquid quench fluid pressure within the full length of annular cavity 206, which is subsequently followed by substantially uniform emission of liquid quench fluid 120 from the annular cavity 206 through channel 212 and onto inner wall 106. The exact shape or flow path direction of peripheral channel 212 from annular cavity 206 to perimeter opening 109 is not critical and may be substantially curved, flat, linear, or include angled flow paths, such as the substantially right angled flow path illustrated in FIG. 2. The sum of the first and second flow components preferably result in a resultant hydraulic flow path that is substantially linear from the cavity 206 to the perimeter aperture 109, or curvilinear if the flow path is tapered or otherwise has hydraulic variance along its length.

It is also important that the quench fluid is introduced into annular cavity 206 substantially tangentially, such that the fluid energy is dissipated along the outer wall surface 209, centrifugally filling cavity 206. In addition to containing the liquid quench fluid within the annular cavity, outer wall 209 and 210 functions to facilitate pressurized displacement of liquid quench fluid through the channel and onto inner wall 106. Preferably, peripheral channel 212 emanates from a portion of cavity 206 that is substantially parallel with outer surface 209, such that first outer wall portion 209 is substantially parallel or flush with another portion 210 of outer wall 209, 210, e.g., 209 and 210 have the same outer diameter with respect to the effluent through bore centerline. Thereby, fluid leaving annular cavity 206 does not have to overcome the centrifugal force of quench fluid that is tangentially introduced into cavity 206 by moving slightly radially inward, toward the effluent through bore center line, and can merely be displaced directly along first portion 209 of the outer wall and into channel 212, along the another portion 210 of the outer wall. However, channel 212 may also emanate from other portions of annular cavity 206, such as a medial portion of cavity 206, such as illustrated in FIG. 2.

Preferably, cavity 206 includes a larger cavity cross-sectional area than a cross-sectional area of introduction port 204, such that quench fluid 120 may be accelerated through port 204 into annular cavity 206 to provide the necessary energy to uniformly distribute the quench fluid within annular cavity 206, along the first portion 209 of the outer wall, while providing a volume within the annular cavity for dissipation of a portion of the introduction energy, during circumferential distribution within the cavity. It is also preferably that the effective, hydraulic, cross-sectional aperture area of peripheral channel 212 is smaller than the effective hydraulic cross-sectional area of annular cavity 206 to provide the hydraulic impedance or remoteness between the annular cavity 206 and peripheral opening 109. Thereby, peripheral channel 212 may provide a flow resistance or pressure drop against the liquid quench fluid 120 within annular cavity 206 to facilitate substantially uniform distribution of liquid quench fluid 120 and pressure within the annular cavity 206, without excessive or non-uniform loss of quench fluid 120 from annular cavity 206, into channel 212 or bore 107. Stated differently, annular cavity 206 is thus hydraulically "remote" with respect to perimeter opening 109 and bore 107. This remoteness or separation is substantially synonymous with and due at least in part to the created hydraulic resistance through channel 212 and due in part to the proximity of annular cavity 206 being segregated from perimeter opening 109 or bore 107. The channel sizing and design, and amount of hydraulic resistance required and fluid pressure within the annular cavity will depend upon many system factors, such as pyrolysis furnace and quench system operating conditions, rates, design and type of the quench system, number of sequential quench steps, desired quench duty, fluid properties, feed properties, etc. Typically, the hydraulic resistance through the channel or the pressure differential between an average pressure within the annular cavity and the pressure within the effluent through bore will be within a range of from a few tenths of a psig to fifty psig. Typically, however, the pressure in the annular cavity may only need to be from a few tenths of a psi to less than about twenty psig greater than the pressure in the effluent stream at the peripheral opening.

In some embodiments, liquid quench fluid 120 may be introduced into annular cavity 206 via a single introduction port 204, while in some preferred embodiments, quench fluid 120 may be introduced into annular cavity 206 via two introduction ports 204, each on opposite sides of bore 107 and oriented to tangentially introduce the quench fluid 120 in the same direction as the other port 204 to provide uniform direction of fluid flow within cavity 206. In other alternative embodiments, the fluid may be introduced into cavity 206 via three or more introduction ports. Computer modeling studies have demonstrated that a pair of introduction ports 204, each substantially 180 degrees opposed to the other and oriented for uniform tangential quench fluid introduction, may provide an efficient, effective, and preferred assembly.

Displacement of the quench fluid through the peripheral channel 212 is preferably substantially uniform in rate and effluence around the entire periphery of the through bore 107, onto the inner wall 106. The step of radially displacing the quench fluid preferably includes distributing the quench fluid film along the axial length of the through bore internal process surface by a combination of gravitational force and effluent fluid-shear force. Preferably, the through bore is oriented in a flow direction that is vertical or perpendicular with respect to a normal ground surface plane. Preferably each cooling conduit 102 is preferably oriented substantially vertical and perpendicular with respect to level ground surface and effluent from hydrocarbon pyrolysis passes preferably downward through the bore 107. The gaseous effluent 100 is passed from an effluent inlet 110 positioned upstream of the channel 212 to a quenched effluent outlet downstream of the channel 212, with respect to the flow stream of the gaseous effluent along the bore 107.

As discussed above, it is desired that while channel 212 serves to fluidly link annular cavity 206 with effluent bore 107, the peripheral channel 212 according to this invention also serves to fluidly segregate the dynamic, inertial energy contained in the fluid 120 that is tangentially introduced through port 204 into cavity 206, from the lower dynamic energy in the fluid that is finally introduced through perimeter opening 109 and onto surface 106. The inertial injection energy in the annular cavity 206 is largely confined and spent distributing the fluid about the annular cavity and maintaining pressure within the cavity 206, such that primarily the pressure energy in the annular cavity is expended in moving the liquid quench fluid through the channel 212.

After tangentially entering annular cavity 206 of the inventive quench fitting 102, the quench fluid disperses along the full volume of the cavity 206, dissipating centrifugal force energy along outer wall 210. Then the quench fluid preferably undergoes a lateral change in flow direction within the annular cavity 206 and begins moving with a directional component that is substantially parallel to the effluent through bore 107 center axis C/L. Preferably the channel directs the liquid quench fluid in a direction opposite the direction of effluent flow along through bore 107, particularly when the effluent 100 is flowing down through a vertically oriented conduit 102. For instances where the effluent flows upward with respect to a vertically oriented conduit 102, the channel may preferably direct the liquid quench fluid in a direction that is same as the direction of effluent flow 100. Thereby, the channel preferably always directs the liquid quench fluid in an upward direction for at least a portion of the flow path through the channel 212. According to an embodiment such as illustrated in FIG. 2, as the effluent enters and traverses the peripheral channel 212 with this upward directional component, (whether parallel to bore 107 center line or as a directional component of a flow path that is angular or curved with respect to bore 107 centre line), the effluent flow path along the channel may change directions to begin flowing with a direction component that is radially inward toward the effluent through bore center axis until it finally traverses to the channel 212 opening at the peripheral opening 109. These combinations of features serve to segregate the aspect of distributing the quench fluid around the through bore from the step of introducing the effluent into the through bore. The segregation or hydraulic remoteness enables improved distribution of quench fluid, improved uniformity of quench film thickness, and efficiency of quench film formation, as compared to the prior art. The process enables use of lower volumes of quench fluid to effect an effective quench fluid film coverage along inner surface 106, as compared to prior art.

Each of the multiple indirect heat exchange cooling conduits or quench exchangers 102 illustrated in FIG. 1 comprises an internal process wall 106 for contacting the hot effluent and an external shell side 108 (see also FIG. 2) for contacting a heat exchange fluid for indirect heat exchange and heat recovery. The cooling conduits also include an effluent inlet 110 and a quenched effluent outlet 112 from which is recovered a cooled, hydrocarbonaceous effluent. In some aspects, the cooled effluent will be at a temperature below that at which the tar precursors condense. A quench fluid introduction port 204 introduces the liquid quench fluid, preferably a distillate oil and more preferably an aromatic-containing distillate oil, into annular cavity 206 and channel 212. Preferred liquid quench fluids 120 that may be particularly useful for creating a wet wall liquid quench fluid film on inner wall 106 may include a liquid quench oil, such as an aromatic oil. Preferred aromatic oil may have a final boiling point of at least about 400° C. (750° F.). Other particularly useful liquid quench fluid may include an aromatic distillate, such as a distillate that is recovered from the cooled gaseous effluent stream 100. Preferred liquid quench fluids may also be substantially free of tar precursors. Preferably, the liquid quench fluid 120 may be introduced into annular cavity 206 as a function of at least one of (i) the rate at which hydrocarbon feed is supplied to the cracking furnace radiant section and/or (ii) the temperature of the cooled gaseous effluent from the cooling conduit outlet 112.

Figure 3:
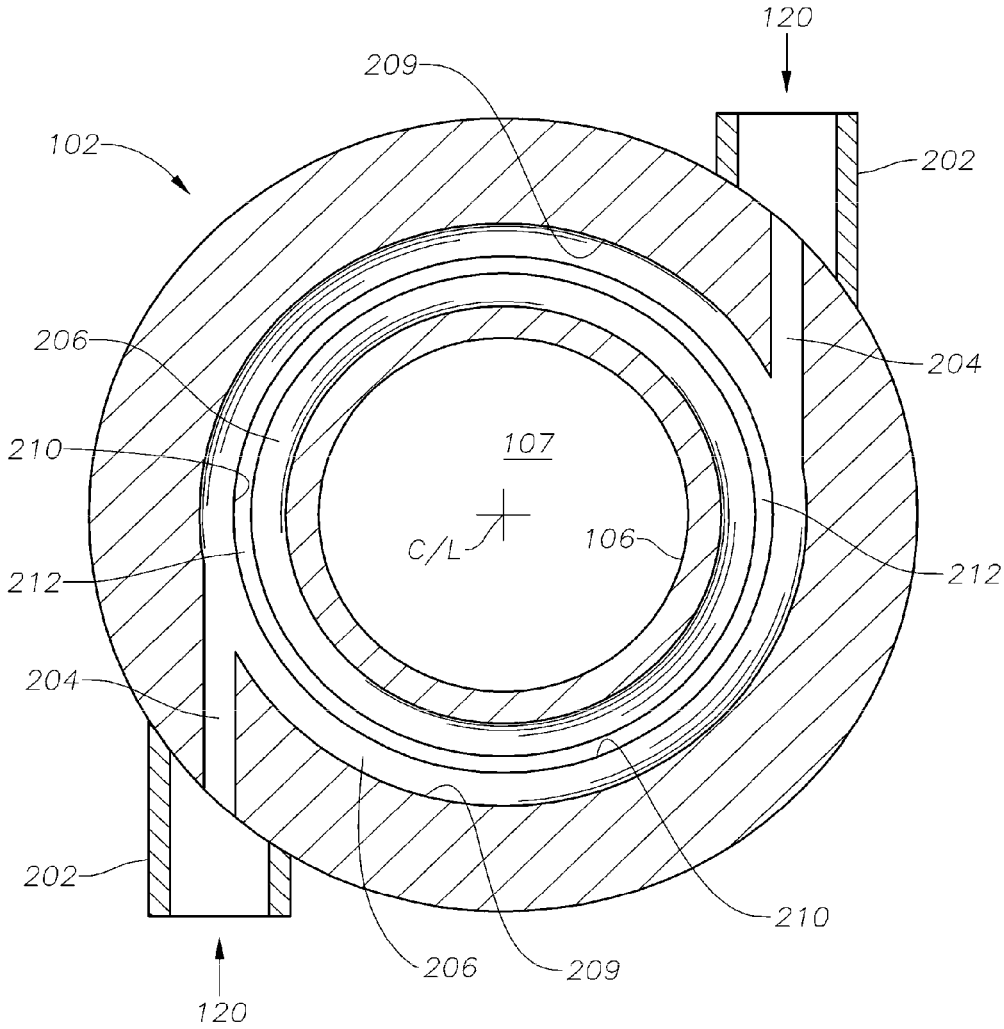
FIG. 3 is a cross-sectional view of the cooling conduit of FIG. 2, at section 3-3.

Preferably, as illustrated in FIG. 2, liquid quench fluid introduction port 204 is located axially downstream of effluent inlet 110. Preferably, as illustrated in FIG. 3, the quench port 204 introduces liquid quench fluid tangentially into annular cavity 206 with respect to the circumferential perimeter of annular cavity 206 to distribute quench fluid substantially uniformly and circumferentially around the full circumference or peripheral length of annular cavity 206, without directing the quench fluid 120 directly into the channel 212. The term "tangential" preferably means at substantially a right angle with respect to a radius from the point of tangent intersection to the effluent through bore centerline, but may also include other angles that are more oblique or more acute at the point of tangent intersection, such as plus or minus fifteen degrees with respect to a right angle. It is generally preferred that the inlet port 204 direct the liquid quench fluid 120 into the circular fluid path around the annular cavity 206 and it is further preferred that the cooling conduit 102 provide two tangential inlet ports 204, such as illustrated in FIG. 3. FIG. 3 also illustrates channel 212 positioned substantially medially with regard to a cross-section of annular cavity 206. However, in some embodiments, it may also be preferred that a first portion 209 of outer wall within the annular cavity 206 is substantially flush with a second portion 210 of outer wall within the first portion of channel 212 substantially adjacent the annular cavity 206. Thereby, the channel 212 connects with the annular cavity 206 at a portion of the annular cavity 206 having the maximum diameter with respect to a center line axis along the center of the effluent through bore 107, such that at least a portion of the channel flow path includes an outer diameter that is substantially the same as an outer diameter of the annular cavity 206.

Annular cavity 206 is preferably sized to serve as a distribution chamber 206 that facilitates uniform distribution and pressurization of quench fluid within channel 212, independent of the shearing influence of the furnace effluent gas stream 100. Uniform and controlled fluid distribution and film creation on wall 106 is important when operating at low quench to feed ratios, such as made possible by this invention. Preferably, when the quench fluid exits channel 212, a substantial portion of the tangential swirl component of the quench fluid has been lost due to skin friction effects, both within the annular cavity 206 and channel 212, and the fluid is introduced substantially longitudinally onto inner wall 106 as the fluid 120 emanates from peripheral opening 109. In some embodiments, the liquid quench fluid is turned through a final 90-degree bend at perimeter opening 109, such as illustrated in FIG. 2 and is emitted longitudinally along the wall 106, in parallel with the flowing furnace effluent 100.

In some preferred embodiments, annular cavity 206 provides at least as much volumetric capacity and preferably at least twice as much capacity, as the capacity of channel 212, such that the annular cavity 206 provides a quench fluid supply reservoir that uniformly provides quench fluid to quench fluid channel 212 with minimal pressure differential, around the full circumference of the inner wall 106. The volumetric capacity of annular cavity 206 also provides capacity for dissipation of any inertial introduction energy from the introduced quench fluid 120 within the annular cavity 206, whether by tangential, oblique, or perpendicular introduction of quench fluid into annular cavity 206 is feasible, although tangential is preferred to facilitate uniform filling of annular cavity 206. Thereby, quench fluid 120 may be introduced through channel 212 and onto inner wall 106 in a controlled, substantially uniform fashion that avoids spraying or otherwise dispersing the quench fluid into bore 107. Further, annular cavity 206 may facilitate generally even distribution and supply of quench fluid from the port 204 or points of introduction, circumferentially around the full periphery of bore 107.

It is preferred that annular cavity 206 be shaped as a substantially torroidal-shaped channel, notch, or slot, such as illustrated in FIG. 2. The cross-sectional shape of annular cavity 206 is not generally critical and may be for example, rounded, include a substantially flat wall, or shaped as an elongated slot, so long as quench fluid 206 is easily dispersed throughout the cavity. A preferred process includes energetic introduction of liquid quench fluid 120 through fluid introduction fitting 202 and port(s) 204, so as to cause rotation or swirl of liquid quench fluid through the circular course of annular cavity 206. However, in some alternative embodiments, annular cavity 206 may be substantially the same component as channel 212 or essentially the same or similar size and shape or geometry as channel 212, such that it becomes difficult to distinguish where the cavity ends and the channel 212 begins. All of such embodiments are considered to be embodiments of the present invention.

Preferably, quench fluid introduction port(s) 204 introduces quench fluid 120 into annular cavity 206 at an axial position with respect to through bore 107 that is offset, at least slightly, and not directly in line with the axial position of a plane containing channel 212 to avoid direct, inertial injection of quench fluid from port 204 into bore 107 or directly into channel 212, and to thereby avoid nonuniform distribution of quench fluid circumferentially around inner wall 106. The introduced quench fluid 120 may serve as a wall wetting liquid quench fluid and/or as a direct quench fluid to directly cool the effluent 100. The quench fluid introduction rates in a direct quench application may typically be substantially higher than quench fluid introduction rates in some other applications, such as indirect heat exchange without direct quench, as required to achieve proper heat balance. To facilitate or assist in substantially uniform distribution of quench fluid 120 around the periphery of annular cavity 206, some processes according to this invention may utilize multiple quench fluid introduction ports 204 and multiple quench fluid fittings 202. Some preferred embodiments utilize two quench fluid introduction ports, each positioned on a side of the cooling conduit opposite the other. Although the amount of offset is not critical, preferably, the offset between the annular cavity 206 and the perimeter opening comprises an offset displacement of at least the smallest internal diameter of the liquid quench fluid introduction port 204, such that port 204 does not appreciably feed liquid quench fluid 120 directly into channel 212, as stated previously. With regard to channel 212 shape or channel flow path orientation, it may be preferred that channel 212 flow path include a curved or angular component, so as not to merely provide a linear or direct flow path from the annular cavity to the perimeter opening, whereby the change in direction can provide at least a portion of the hydraulic resistance through the channel. However, it is also preferred that the channel flow path includes a change in flow direction, such as an angular change of at least about 45 degrees, between a first portion of the channel 212 flow path substantially adjacent the annular cavity and a second portion substantially adjacent the perimeter opening 109. In still other embodiments, it may be preferred that the channel flow path includes a more substantial change in flow direction, such as an angular change of at least about 90 degrees, between the first portion of the channel 212 adjacent the annular cavity and the second portion adjacent the perimeter opening 109, such as illustrated in FIG. 2.

To avoid direction introducing liquid quench fluid from introduction port 204 directly into channel 212, it is desirable to provide an angular offset within the annular cavity 206, as between the direction of fluid introduction from the introduction port 204 into annular cavity 206 and the first portion of the flow path of channel 212. For example, it may be desirable in some embodiments for an initial portion of channel 212 flow path that is adjacent the annular cavity 206 to flow in a direction that is substantially parallel with the effluent through bore. For further example, it may be desirable that at least one quarter of the total length of the flow path for channel 212 is substantially parallel with the center line axis through the effluent through bore 107. This arrangement would, by further example, not only include specific parallel flow, but also such portion of a directional component of a flow path that is at an angle with respect to the effluent through bore 107 center line. In one preferred orientation, such parallel portion of the channel may thus generally be oriented upward and specifically parallel to the effluent through bore 107 for about a quarter or more of the total length of the channel 212, whereby liquid quench fluid 120 is displaced from the annular cavity 206 and must travel generally upward (or at least with an upward directional component, such as at an upward angle) through a portion (at least one quarter of the total length) of the channel 212, and then moves through a substantially right angle and in a radially inward direction toward the perimeter opening 109.

In some preferred embodiments, the cooling conduit or quench exchanger 102 also includes an indirect heat exchanger, such as a double pipe quench exchanger as illustrated in FIG. 2, to enhance quenching and facilitate indirect heat recovery and recycle. Preferred embodiments may include heat exchange fluid jacket 122, coaxially external to outer quench tube 104. Cooling conduit 102 may include quench exchanger tube 104 as a heat transfer tube providing external shell surface 108, creating a heat exchange fluid annulus 125 with coaxial heat exchange jacket 122. Preferably, heat exchange annulus 125 is positioned axially downstream of quench fluid channel 212 for contacting a heat exchange fluid 124, e.g., water or steam, with the external shell side 108 of the quench tube 104. Preferably, heat exchange fluid jacket 122 is positioned sufficiently downstream of the annular quench fluid injection port 204 and channel 212 to permit heating of the quench fluid film on inner surface 106 to about the saturation temperature of steam. Jacket 122 is preferably, substantially coaxial to the quench tube 104 and further comprises a heat exchange fluid inlet 126 for providing heat exchange fluid 124 having a temperature lower than the effluent temperature. Preferably, heat exchange fluid inlet 224 is supplied heat exchange fluid 124 by heat exchange fluid inlet manifold 127, and heat exchange fluid outlet 128 removes heated heat exchange fluid 130, e.g., heated liquid water or steam from heat exchange fluid outlet port 228 via heat exchange fluid outlet manifold 132. The inlet and outlet positions may be switched with each other, if so desired. As illustrated in FIG. 2, in heat exchange fluid may enter the fluid jacket 125 through indirect heat exchange fluid port 224 and exit from the fluid jacket through indirect heat exchange fluid outlet port 228.

The quench exchanger 102 preferably may operate with furnace effluent 100 and quench fluid 120 flowing downward along through bore 107 while saturated high pressure boiler feed water/steam flows upward in the annulus 125 surrounding the cooling tube, although other exchanger geometries may also be suitable. The boiler feed water/steam circuit is preferably arranged as a natural thermosyphon, operating from an elevated steam drum, as is common in ethylene furnaces, such as described in "Latest Developments in Transfer Line Exchanger Design for Ethylene Plants", H. Herrmann & W. Burghardt, Schmidt'sche Heissdampf-Gesellschaft, prepared for presentation at AIChE Spring National Meeting, Atlanta, April 1994, Paper #23c.

As stated previously, in some embodiments or processes it may be desirable to provide a short distance of unjacketed (non-indirectly cooled) through bore between the quench fluid introduction channel 212 and heat exchange annulus 125. For example, when generating high pressure steam from the indirect heat exchange, the length of the non-indirectly cooled through bore should be selected such that the quench fluid film on inner wall 106 is heated to about the saturation temperature of the steam, before the quench fluid film enters the jacketed 122 (cooled) portion of the exchanger tube 104. Also, as the liquid quench fluid film is heated, it cools and condenses the heavy components in the gaseous pyrolysis effluent, thereby replacing at least a portion of the vaporized quench fluid with in-situ generated film-forming liquid, particularly with regard to direct quench processes. Thereby the quench fluid film is further maintained along the tube wall 106, even as portions of the quench fluid are vaporized. The quench fluid is delivered from channel 212 at a rate that ensures adequate liquid quench fluid flow along the wall 106 from the moment or temperature at which the first, heaviest components of the furnace effluent are condensed, and until substantially all of the condensable tar precursors are condensed, to minimize or prevent fouling.

Referring again to FIG. 1, quench fluid 120 may be supplied to a quench exchanger bank by a manifold that feeds quench fluid inlet tubes 116, preferably at a tangent as illustrated in the figure. Outlet 134 is provided for removing a mixture 136 of cooled gaseous effluent, heated liquid quench fluid, and cooled tar precursors entrained within the cooled stream. The clean out port on bottom of the cooling conduit 102 and effluent outlet 134 are preferably positioned near the gaseous effluent discharge 112 end of the cooling conduit 102. Multiple outlets 134 may be manifolded together into a common manifold.

Liquid quench fluid 120 is introduced to the annular cavity 206 through quench fluid injector port 204. In one aspect of the invention, introducer port 204 may be sized to provide sufficient back-pressure to generate good quench fluid distribution to all of the injectors in a manifolded quench exchanger bank, such as illustrated in FIG. 1. According to one preferred embodiment, the cooling conduit 102 comprises a direct quench fluid introduction port for introducing a direct quench fluid into the gaseous effluent stream to quench the gaseous effluent. This direct quench fluid introduction port may be a port that is separate from a port used to introduce the liquid quench fluid that creates the wetted wall film. In other preferred embodiments, however, the direct quench fluid introduction port(s) is the same port(s) that is used to introduce the liquid quench fluid that forms the wetted wall film. In such embodiments, the direct quench fluid introduction port comprises or is the liquid quench fluid introduction port and the direct quench fluid comprises or is the liquid quench fluid. The direct quench fluid thus passes through the annular cavity, channel, and perimeter opening.

The generalized cooling conduit illustrated in FIG. 2 demonstrates a substantially flush effluent through bore 107, having substantially a constant internal diameter over the full axial length of the bore 107. However, in some embodiments, through bore 107 may include variations in internal diameter. For example, the internal diameter of the bore 107 upstream of the perimeter opening 109 may be of a smaller internal diameter than the diameter of the bore 107 downstream of the perimeter opening 109. Thereby, the piping provides additional capacity for the introduced quench fluid 120, such as for a direct quench process. An internal diameter change may also be provided at or near the perimeter opening to provide for thermal expansions or displacements between piping upstream of the perimeter opening 109 and downstream of the perimeter opening 109. In some embodiments, the channel 212 may include a change in direction of the quench fluid flow path at the perimeter opening, such that the perimeter opening 109 generally faces along the effluent through bore, parallel with the bore wall 106. Thereby, the quench fluid 120 may be emitted directly only the bore wall 106 with reduced exposure to the shear effects caused by the effluent stream 100 flowing in the bore 107.

Computer modeling of an embodiment of the inventive wetted wall cooling conduit or quench exchanger process and apparatus predicts that liquid quench fluid mass flow rates with a quench to furnace feed ratio of as low as from about 0.2, and in some instances even as low as from about 0.1, can provide an effective wetted wall film. The operable wetted wall liquid quench feed ratio range may extend upward from about 0.1 to a ratio of at least about 5.0, or even higher if desired, such as with direct quench applications. An anticipated preferential operating range for wetted wall liquid quench fluid introduction may have a mass ratio within a range of from about 0.1 to about 4.0. An anticipated preferential operating range for an indirect heat exchange application that does not substantially rely upon direct quench, may have a ratio of from about 0.2 to about 0.5. An anticipated preferential operating range for wetted wall direct quench fluid introduction may have a mass ratio within a range of from about 0.5 to about 4.0, depending largely upon the required heat duty. Clearly, the different operational, design, and geometrical features of the injector of the present invention have generated a significant improvement in wetted wall quench system performance, even for low liquid quench fluid to furnace feed ratio operations. For some typical applications, it may be desirable to utilize the process or apparatus of the subject invention to introduce the liquid quench fluid onto the inner wall at a liquid quench fluid to furnace feed weight ratio ranging from about 0.1 to about 2. In other applications, it may be desirable to introduce the liquid quench fluid onto the inner wall at a liquid quench fluid to furnace feed weight ratio of from about 0.2 to about 1.5. The subject invention may be tailored to fit any of many quench applications, such as by providing an apparatus whereby the channel and/or ports are designed to deliver a rate ratio at a rate of from about 0.1 up to and even in excess of 4.0, by varying the design parameters of the apparatus and/or operating conditions, to supply the desired quench fluid rate or ratio.

While the invention has been described in connection with certain preferred embodiments so that aspects thereof may be more fully understood and appreciated, the description is not intended to limit the invention to only these particular embodiments. On the contrary, the disclosure is illustrative and is intended to cover all alternatives, modifications, and equivalents as may be included within the scope of the invention as generally or particularly described, illustrated, and defined by the following claims.

What is claimed is:

1. A cooling conduit apparatus for cooling gaseous effluent from a hydrocarbon pyrolysis furnace, the cooling conduit apparatus comprising:

(i) an inner wall for contacting said effluent, said inner wall defining a bore extending a length of said cooling conduit, said inner wall including a perimeter opening along said bore;

(ii) an outer wall external to said inner wall and substantially coaxial to said inner wall;

(iii) a substantially annular cavity external to said inner wall and including at least a portion of said outer wall, said annular cavity fluidly and remotely connected to said perimeter opening, said annular cavity externally surrounding a perimeter of said inner wall;

(iv) a peripheral channel extending around a perimeter of said inner wall, said peripheral channel providing a channel flow path that fluidly connects said annular cavity with said remotely connected perimeter opening along said perimeter of said inner wall; and (v) a liquid quench fluid introduction port for introducing said liquid quench fluid into said annular cavity; wherein said channel connects with said annular cavity at a portion of said annular cavity having the maximum diameter with respect to a center line axis along the center of said bore, such that at least a portion of said channel includes an outer diameter that is substantially the same as an outer diameter of said annular cavity.

2. The cooling conduit apparatus of claim 1, further comprising a tangentially oriented liquid quench fluid introduction port for tangentially introducing liquid quench fluid into said annular cavity.

3. The cooling conduit apparatus of claim 1, further comprising:

a heat exchange fluid jacket for maintaining an indirect heat exchange fluid in contact with an external side of said inner wall, said jacket comprising a heat exchange fluid inlet and a heat exchange fluid outlet.

4. The cooling conduit apparatus of claim 3, wherein said cooling conduit apparatus comprises at least one of a double tube type heat exchanger, a transfer line exchanger, and a shell and tube type heat exchanger.

5. The cooling conduit apparatus of claim 1, further comprising a direct quench fluid introduction port for introducing a direct quench fluid into the gaseous effluent stream to quench said gaseous effluent.

6. The cooling conduit apparatus of claim 5, wherein said direct quench fluid introduction port comprises said liquid quench fluid introduction port and said direct quench fluid comprises said liquid quench fluid.

7. The cooling conduit apparatus of claim 1, further comprising at least two liquid quench fluid introduction ports, each spaced substantially evenly about the circumference of said quench exchanger bore with respect to the position of the other of the at least two liquid quench fluid introduction ports.

8. The cooling conduit apparatus of claim 1, wherein the hydraulic conductivity of said channel from said annular cavity to said perimeter opening is sized to provide a liquid quench fluid to furnace feed weight ratio within a range of from about 0.1 to about 4.0, based upon the desired operating conditions, quench fluid flow properties, and gaseous effluent stream properties.

9. The cooling conduit apparatus of claim 2, wherein at least a portion of said channel flow path is offset as compared to a plane that includes a bore-axis of said liquid quench fluid introduction port.

10. The cooling conduit apparatus of claim 1, wherein said channel flow path further comprises an angular change in flow direction of at least about 45 degrees.

11. The cooling conduit apparatus of claim 1, wherein said channel comprises a hydraulic resistance between said annular cavity and said perimeter opening.

* * * * *